US008967610B2

(12) United States Patent
Takashima

(10) Patent No.: US 8,967,610 B2
(45) Date of Patent: Mar. 3, 2015

(54) SHEET PROCESSING DEVICE AND IMAGE FORMING SYSTEM

(71) Applicant: Ikumi Takashima, Aichi (JP)

(72) Inventor: Ikumi Takashima, Aichi (JP)

(73) Assignee: Ricoh Company, Limited, Tokyo (JP)

( * ) Notice: Subject to any disclaimer, the term of this patent is extended or adjusted under 35 U.S.C. 154(b) by 68 days.

(21) Appl. No.: 13/788,043

(22) Filed: Mar. 7, 2013

(65) Prior Publication Data

US 2013/0243511 A1 Sep. 19, 2013

(30) Foreign Application Priority Data

Mar. 13, 2012 (JP) ..... 2012-055961

(51) Int. Cl.

| | |
|---|---|
| ***B65H 37/04*** | (2006.01) |
| ***B26D 7/01*** | (2006.01) |
| ***B26F 1/00*** | (2006.01) |
| ***B41L 21/00*** | (2006.01) |

(52) U.S. Cl.

CPC ..... *B26D 7/015* (2013.01); *B26F 1/0092* (2013.01); *B41L 21/00* (2013.01); *B65H 37/04* (2013.01); *B65H 2801/27* (2013.01)

USPC ..... 270/58.07; 270/58.08

(58) Field of Classification Search

CPC ..... B31F 5/001; G03G 2215/00818; B26F 1/0092; B26F 1/02; B65H 37/04; B65H 9/04

USPC ..... 270/37, 58.07, 58.08, 58.11, 58.12, 270/58.17, 58.27; 83/466

See application file for complete search history.

(56) References Cited

U.S. PATENT DOCUMENTS

| | | | | |
|---|---|---|---|---|
| 5,667,211 | A * | 9/1997 | Reist | 270/52.16 |
| 7,431,273 | B2 * | 10/2008 | Kamiya et al. | 270/37 |
| 7,566,051 | B2 * | 7/2009 | Kodama et al. | 270/58.12 |
| 7,758,034 | B1 * | 7/2010 | Namba et al. | 270/58.07 |
| 7,883,079 | B2 * | 2/2011 | Sato et al. | 270/32 |
| 8,191,884 | B2 * | 6/2012 | Sato et al. | 270/58.08 |
| 2006/0204298 | A1 | 9/2006 | Hari | |
| 2007/0176357 | A1 | 8/2007 | Horio et al. | |
| 2009/0152792 | A1 | 6/2009 | Kato et al. | |

FOREIGN PATENT DOCUMENTS

| | | |
|---|---|---|
| JP | 09-175724 | 7/1997 |
| JP | 2007-031095 | 2/2007 |

* cited by examiner

*Primary Examiner* — Leslie A Nicholson, III

(74) *Attorney, Agent, or Firm* — Harness, Dickey & Pierce P.L.C.

(57) ABSTRACT

A sheet processing device includes a clamp configured to clamp an edge portion of a sheet, the edge portion being on a side of an edge parallel to a direction in which the sheet has been conveyed; a first processing unit configured to perform a first process on the sheet at the side of the edge, the first processing unit being disposed at a first position; a second processing unit configured to perform a second process on the sheet at the side of the edge, the second processing unit being disposed at a second position that is different from the first position in a vertical direction; and a moving unit configured to move the clamp from the first position to the second position or vice versa so that the clamp moves on a loop passing through the first position and the second position.

9 Claims, 5 Drawing Sheets

(a) RECEIVE SHEET AT PUNCH STAGE (b) CLAMP 401a AT PUNCH STAGE IS CLOSED AND HOLES ARE PUNCHED (c) CLAMP 401a IS MOVED ALONG GUIDE 402, PUSHING SHEET CLAMPED BY CLAMP 401a OUT OF PUNCHING UNIT CLAMP 401b IS MOVED TO PUNCH STAGE ALONG GUIDE 402

(d) WHEN TRAILING END OF SHEET CLAMPED BY CLAMP 401a REACHES ABUTTING MEMBER 502, CLAMP 401a IS OPENED CLAMP 401b IS AT SHEET RECEIVING POSITION FOR PUNCH STAGE

SHEET PROCESSING DEVICE AND IMAGE FORMING SYSTEM

CROSS-REFERENCE TO RELATED APPLICATION

The present application claims priority to and incorporates by reference the entire contents of Japanese Patent Application No. 2012-055961 filed in Japan on Mar. 13, 2012.

BACKGROUND OF THE INVENTION

1. Field of the Invention

The present invention generally relates to a sheet processing device and an image forming system that includes the sheet processing device and an image forming apparatus.

2. Description of the Related Art

Devices, which are called as sheet processing devices, that automatically perform sheet processing such as alignment, stapling, and/or punching on sheets on which images are formed have been widely known. Image forming systems that include an image forming apparatus and this type of sheet processing device connected to the downstream of the image forming apparatus are widely used in recent years. Such a sheet processing device performs sheet finishing, e.g., stacking and stapling. Stacking is a process of stacking sheets on an eject tray while sorting the sheets into sets of sheets. Stapling is a process of stapling each sheet bundle made up of a predetermined number of sheets and stacking the sheet bundles on a stack tray.

Known examples of this type of technique are disclosed in Japanese Patent Application Laid-open No. 9-175724 and Japanese Patent Application Laid-open No. 2007-31095. Specifically, Japanese Patent Application Laid-open No. 9-175724 discloses a sheet finisher that receives printed sheets ejected from an image forming apparatus and distributes the sheets onto a plurality of bins and staples each sheet bundle on the bins. The sheet finisher includes a chuck device that advances toward a trailing-edge center portion of the sheet bundle distributed on one of the bins, chucks the trailing-edge center portion, and conveys the sheet bundle to a stapler located to the rear of the bin. The chuck device performs this operation for each of the bins. The chuck device includes a chucker that clamps the trailing-edge center portion of the sheet bundle loaded on the inclined bin and a moving unit that moves the sheet bundle clamped by the chucker to the stapler disposed on a downstream extension of the sheet bundle.

Japanese Patent Application Laid-open No. 2007-31095 discloses a sheet finisher that performs postprocessing on sheets. The sheet finisher includes a hole puncher (lateral-hole punching unit) that punches holes for use in sheet binding (hereinafter, "binding holes") in predetermined positions of sheets. The hole puncher, which is movable, moves to binding-hole positions and punches the binding holes. According to this technique, a line connecting the binding holes punched by the lateral-hole punching unit is parallel to a sheet conveying direction. The lateral-hole punch, which is movable, moves to the binding-hole positions and punches the binding holes.

However, the technique disclosed in Japanese Patent Application Laid-open No. 9-175724 is disadvantageous in that the sheet bundle is not moved up and down. This is because although the sheet bundle clamped by the chucker is movable in a conveying direction, the sheet bundle is unmovable in the vertical direction. The sheet finisher disclosed in Japanese Patent Application Laid-open No. 2007-31095 has disadvantageously complicated structure to allow the punching unit to move when punching the binding holes. In addition, a large driving source is necessary to move the punching unit.

Therefore, there is a need to provide a sheet processing device capable of moving sheets with a simple structure without using a large driving source, thereby achieving miniaturization.

SUMMARY OF THE INVENTION

It is an object of the present invention to at least partially solve the problems in the conventional technology.

According to an embodiment, there is provided a sheet processing device that includes a clamp configured to clamp an edge portion of a sheet, the edge portion being on a side of an edge parallel to a direction in which the sheet has been conveyed; a first processing unit configured to perform a first process on the sheet at the side of the edge, the first processing unit being disposed at a first position; a second processing unit configured to perform a second process on the sheet at the side of the edge, the second processing unit being disposed at a second position that is different from the first position in a vertical direction; and a moving unit configured to move the clamp from the first position to the second position or vice versa so that the clamp moves on a loop passing through the first position and the second position.

According to another embodiment, there is provided an image forming apparatus that includes the sheet processing device according to the above embodiment.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described below with reference to the accompanying drawings. According to an embodiment of the present invention, a plurality of processing units are set at vertically different positions. A clamp that clamps a portion of a sheet-like recording medium (hereinafter, simply referred to as "sheet"), such as paper, recording paper, transfer paper, or a transparency, is moved by a moving unit in a loop through the positions of the processing units by a simple mechanism, and predetermined processing is performed at the processing positions.

Overall Configuration

Figure 1:
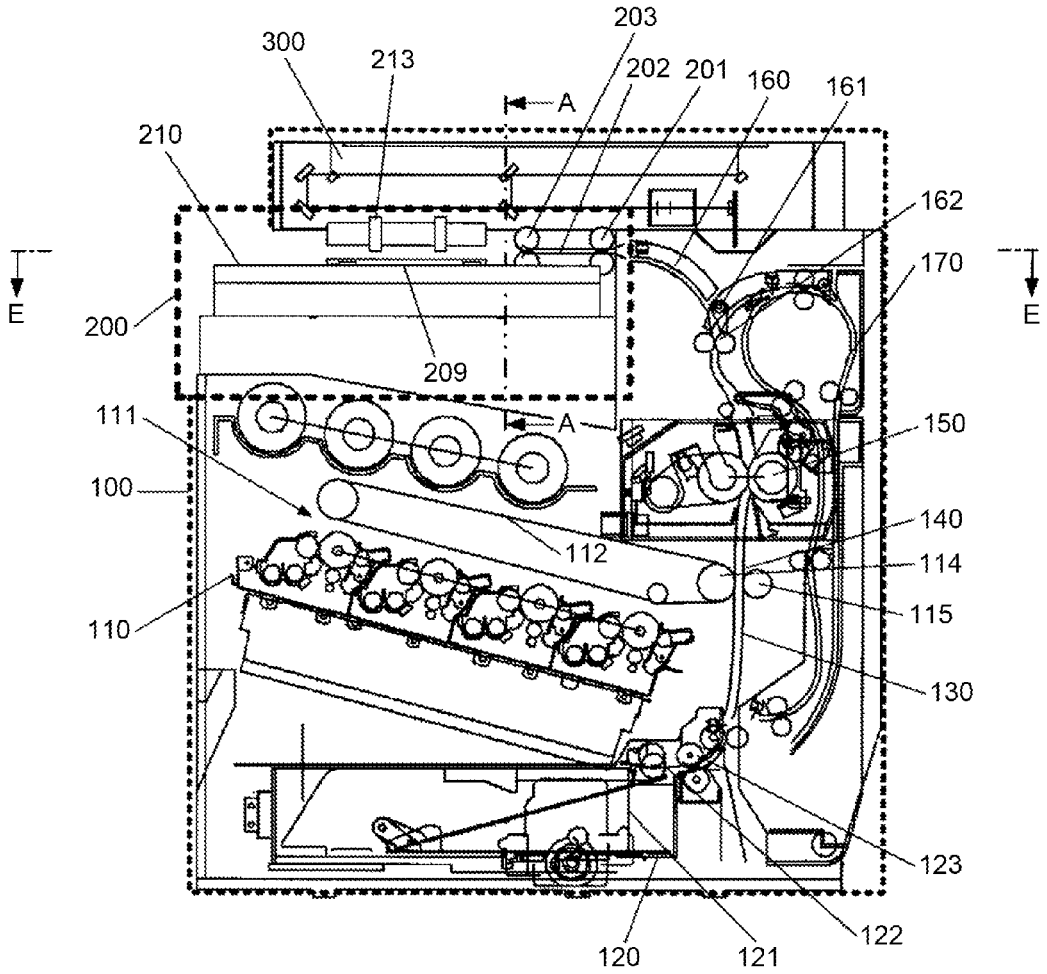
FIG. 1 is a system configuration diagram schematically illustrating an inner structure of an image forming system according to an embodiment of the present invention.
Figure 2:
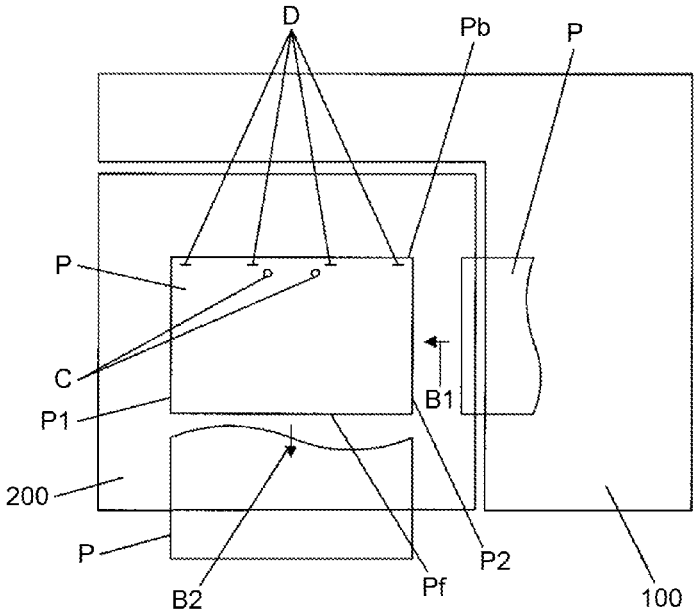
FIG. 2 is a cross-sectional view taken along the line E-E of FIG. 1 to illustrate a schematic configuration of a sheet finisher.

FIG. 1 is a system configuration diagram schematically illustrating an inner structure of an image forming system according to an embodiment of the present invention. The image forming system is, for example, a copier machine, a printer machine, a facsimile machine, or a multifunction peripheral (MFP) having at least two functions of these machines. FIG. 2 is a cross-sectional view taken along the line E-E of FIG. 1 to illustrate a schematic configuration of a sheet finisher, indicating relationship between arrangement of units and sheets. Referring to FIGS. 1 and 2, the image forming system according to the embodiment includes an image forming apparatus 100, a sheet processing device 200, and an image scanning apparatus 300. The sheet processing device 200 is a sheet finisher that performs postprocessing on sheets ejected from the image forming apparatus 100. Accordingly, the sheet processing device 200 is hereinafter referred to as the sheet finisher 200.

The image forming apparatus 100 is a tandem color image forming apparatus using an indirect transfer method. The image forming apparatus 100 includes, at or near its center (see FIG. 1), an image forming unit 110 having image forming stations for four colors, an optical writing unit (not shown) disposed below and adjacent to the image forming unit 110, a sheet feeding unit 120 disposed below the image forming unit 110, a sheet-feed conveying path (vertical conveying path) 130 for conveying a sheet picked up from the sheet feeding unit 120 to a secondary transfer unit 140 and a fixing unit 150, an eject path 160 for conveying a sheet, onto which an image is fixed, to the sheet finisher 200, and a duplex-printing conveying path 170 for turning a sheet, on one side of which an image is formed, upside down so that an image is formed on the other side.

The image forming unit 110 includes photosensitive drums for the colors, or Y, M, C and K, in the respective image forming stations 111. There are provided an electrostatic charging unit, a developing unit, a primary transfer unit, a cleaning unit, and a neutralizing unit around each of the photosensitive drums. The image forming unit 110 also includes an intermediate transfer belt 112, onto which images formed on the photosensitive drums are to be intermediately transferred by the primary transfer unit, and the optical writing unit that writes each color image on the surface of each drum. The optical writing unit is disposed below the image forming stations 111. The intermediate transfer belt 112 is disposed above the image forming stations 111.

The intermediate transfer belt 112 is rotatably supported by a plurality of support rollers. A support roller 114, which is one of the support rollers, faces a secondary transfer roller 115 via the intermediate transfer belt 112 in the secondary transfer unit 140 so that secondary transfer of an image from the intermediate transfer belt 112 onto a sheet can be performed. Meanwhile, an image forming process performed by a tandem color image forming apparatus using an indirect transfer method is known and does not have direct relation with the scope of the present invention; accordingly, detailed description is omitted.

The sheet feeding unit 120 includes a sheet feed tray 121, a pickup roller 122, and sheet-feed conveying rollers 123. The sheet feeding unit 120 picks up a sheet from the sheet feed tray 121 and delivers the sheet upward along the vertical conveying path 130. The delivered sheet, onto which an image is transferred in the secondary transfer unit 140, is delivered to the fixing unit 150.

The fixing unit 150 includes a fixing roller and a pressing roller. During a course where the sheet passes through a nip between the fixing roller and the pressing roller, heat and pressure are applied to the sheet, causing toner to be fixed onto the sheet. The eject conveying path 160 and the duplex-printing conveying path 170, into which bifurcation is made at a bifurcating claw 161, are disposed downstream of the fixing unit 150. One of the conveying paths is selected depending on whether a sheet is to be conveyed to the sheet finisher 200 or to the duplex-printing conveying path 170. Meanwhile, bifurcation conveying rollers 162 are disposed immediately upstream of the bifurcating claw 161 with respect to a sheet conveying direction to apply a conveying force to the sheet.

The sheet finisher 200 arranged inside the image forming apparatus 100 performs predetermined processing on an image-formed sheet conveyed from the image forming apparatus 100, and places the sheet on an eject tray 210 arranged most downstream. The sheet finisher 200 will be described in detail later.

The image scanning apparatus 300 is of a known type that scans a document placed on an exposure glass with light to read an image on a document surface. The configuration and function of the image scanning apparatus 300 are known and do not have direct relation with the scope of the present invention; accordingly, detailed description is omitted.

The image forming apparatus 100 configured as roughly described above generates image data for use in writing from document data obtained by the image scanning apparatus 300 by scanning or from print data transferred from an external PC or the like. The optical writing unit performs optical writing on the photosensitive drums based on the image data. Images formed by the image forming stations on a per-color basis are sequentially transferred onto the intermediate transfer belt 112. A color image is formed on the intermediate transfer belt 112 by superimposing the four color images thereon.

Meanwhile, a sheet is fed from the sheet feed tray 121 according to the image forming operation. The sheet is temporarily stopped at a position of registration rollers (not shown) immediately upstream of the intermediate transfer unit 140 and, at timing synchronized to a leading end of the image on the intermediate transfer belt 112, delivered to the intermediate transfer unit 140 where secondary transfer of the image onto the sheet is performed. The sheet is then delivered into the fixing unit 150.

After the image is fixed in the fixing unit 150, when the image is formed for one-side printing or as a second-side image of duplex printing, the bifurcating claw 161 is operated for path switching so that the sheet is conveyed to the eject path 160. On the other hand, the sheet is conveyed to the duplex-printing conveying path 170 when the image is formed as a first-side image of duplex printing. The sheet conveyed to the duplex-printing conveying path 170 is turned upside down, and thereafter eventually delivered into the intermediate transfer unit 140 where an image is formed on a second side of the sheet. Thereafter, the sheet is conveyed to the eject path 160. The sheet delivered to the eject path 160 is conveyed to the sheet finisher 200. The sheet having undergone predetermined sheet processing or no processing in the sheet finisher 200 is ejected onto the eject tray 210.

Sheet Processing Device

Figure 3:
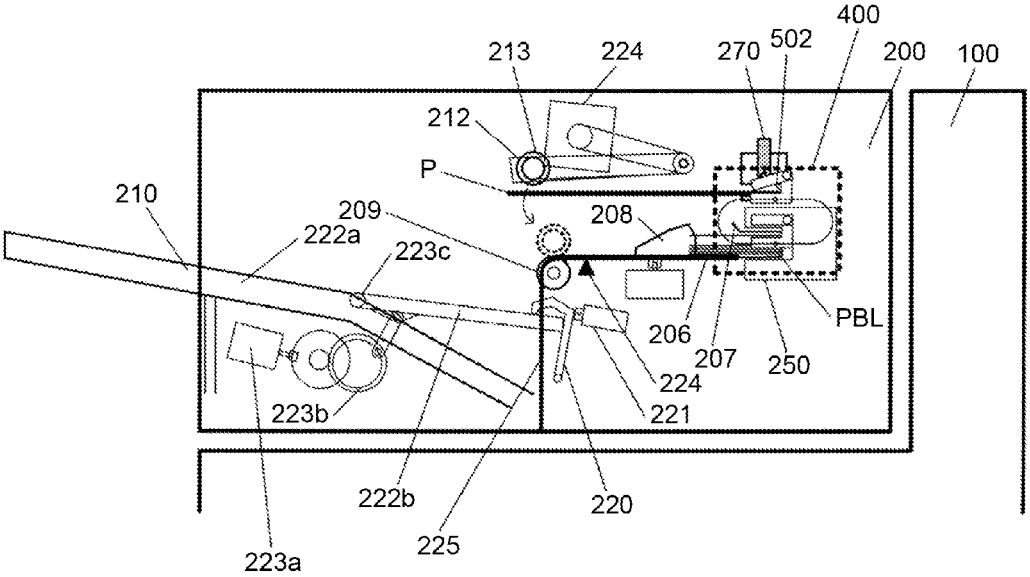
FIG. 3 is a cross-sectional view taken along the line A-A of FIG. 1 to illustrate the schematic configuration of the sheet finisher.
Figure 4:
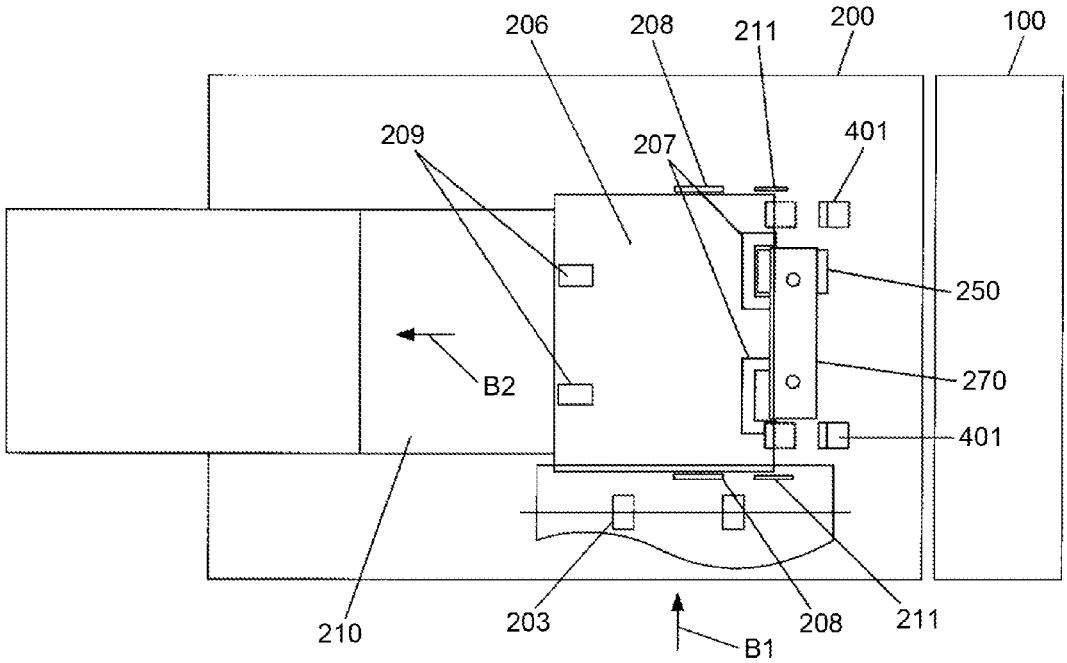
FIG. 4 is plan view of the sheet finisher illustrated in FIG. 3.

FIG. 3 is a cross-sectional view taken along the line A-A of FIG. 1 to illustrate a schematic configuration of the sheet finisher 200. FIG. 4 is plan view of the sheet finisher 200 illustrated in FIG. 3.

Referring to FIGS. 1 to 4, the sheet finisher 200 includes a pair of inlet rollers 201, an eject conveying path 202, conveying rollers 203, punching jogger fences (aligning plates) 211, a clamp unit 400, a staple tray 206, trailing-end reference fences 207, stapling jogger fences (aligning plates) 208, eject rollers 209, and the eject tray 210 that are arranged approximately in this order from upstream to downstream in the sheet conveying direction.

Specifically, at a sheet receiving section of the sheet finisher 200, there are provided the pair of inlet rollers 201 that receives a sheet P from the eject path 160 of the image forming apparatus 100, the eject conveying path 202 along which the received sheet P is conveyed to the punching unit, and the pair of conveying rollers 203. An inlet motor rotates the pair of inlet rollers 201 and the pair of conveying rollers 203, thereby conveying the sheet P along the eject conveying path 202 (in a direction indicated by arrow B1).

An inlet sensor (not shown) that detects a leading end and a trailing end of the sheet P is disposed on the eject conveying path 202. Based on (i) time when the inlet sensor detects the leading end and the trailing end, and (ii) numbers of steps taken by the inlet motor which is a stepping motor, timing for performing various sheet processing is determined. The inlet sensor is disposed near the inlet rollers 201 on the upstream side or the downstream side, for example.

In the image forming apparatus 100 according to the present embodiment, the sheet finisher 200 is arranged as illustrated in FIG. 2 to configure the apparatus compact. Specifically, sheet processing is performed as follows. The sheet P is conveyed by short edge feed (SEF) in the conveying direction indicated by arrow B1 in FIG. 2. When the sheet P has passed through the pair of conveying rollers 203, the conveying direction of the sheet P is changed to a direction (indicated by arrow B2 in FIG. 2) perpendicular to the conveying direction (indicated by arrow B1) along which the sheet P is conveyed from the image forming apparatus 100. To enable such conveyance and sheet processing described above, hole punching positions C and stapling positions D are arranged in the sheet finisher 200 an illustrated in FIG. 2. Specifically, as illustrated in FIG. 2, it is necessary to perform hole punching and stapling on an edge face portion, which is parallel to the sheet conveying (sheet ejecting) direction (indicated by arrow B1), of the sheets P.

Figure 5:
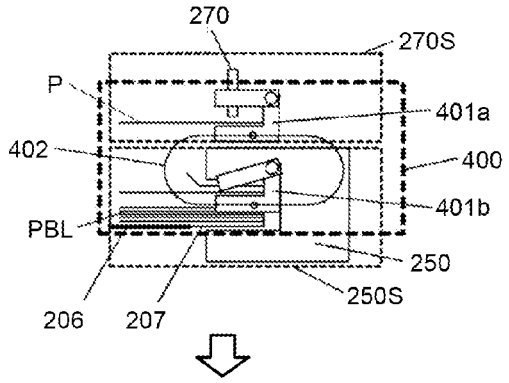
FIG. 5 illustrates operations of a clamp unit.
Figure 5:
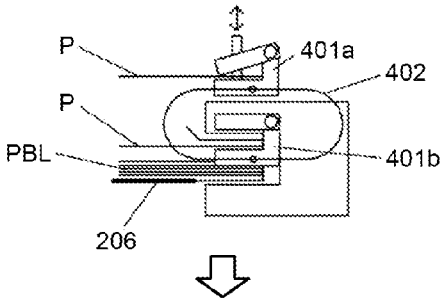
Figure 5:
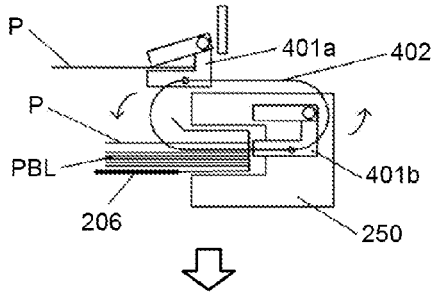
Figure 5:
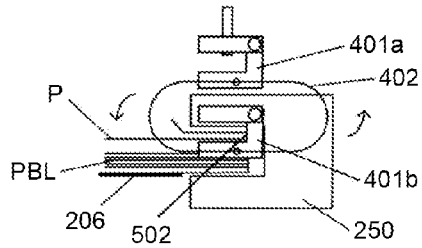

FIG. 5 illustrates operations of the clamp unit. The sheet P ejected from the pair of conveying rollers 203 advances onto a punch stage 270S as illustrated in (a) of FIG. 5 in a state where the sheet P is supported at a portion of a far-side edge Pb by a punching unit 270 and supported at a portion of a near-side edge Pf by the staple tray 206. The punching jogger fences 211 align a sheet leading end P1 and a sheet trailing end P2. The clamp unit 400 is moved to bring the far-side edge Pb into contact with an abutting member 502 provided in the clamp unit 400 to position the sheet P. Subsequently, a first clamp 401*a* clamps the sheet P. Then, as illustrated in (b) of FIG. 5, the punching unit 270 punches a hole through the sheet P at a punching position.

After the punching unit 270 has punched the hole, the first clamp 401*a* moves along a guide 402 as illustrated in (c) of FIG. 5. As a result, the sheet P is pushed out of the punching unit 270 by the first clamp 401*a*. Concurrently therewith, a second clamp 401*b* moves along the guide 402 to the punch stage 270S, while the first clamp 401*a* moves down to a staple stage 250S. When the far-side edge Pb reaches a position where the far-side edge Pb abuts on the trailing-end reference fences 207, the sheet P is released from clamping by the first clamp 401*a*, and falls (is placed) onto the staple stage 250S. At this time, the second clamp 401*b* has been moved to a sheet receiving position for the punch stage 270S.

In a mode that does not include hole punching, the punching operation to be performed by the punching unit 270 illustrated in (b) of FIG. 5 is not performed, but the operations illustrated in (a) to (d) of FIG. 5 are performed to cause the sheet P abutted against the trailing-end reference fences 207 of the staple stage 250S to fall in a manner similar to that described above. After the sheet P has fallen from the punch stage 270S to the staple stage 250S, processing performed on the sheet P differs between the shift mode for shifting and ejecting the sheet P and a staple mode for forming a sheet bundle PBL by stacking a plurality of the sheets P, stapling the sheet bundle PBL, and ejecting the stapled sheet bundle PBL. Accordingly, the shift mode and the staple mode are individually described below together with description about configurations of relevant units.

Shift Mode

In the shift mode, the sheets P are not stapled but sorted into sets, each made up of predetermined number of sheets, that are alternately ejected on the eject tray 210 in a laterally staggered arrangement in the front view of the image forming apparatus (FIG. 1). The stapling jogger fences 208 are disposed on the staple tray 206. Guide shafts (not shown) fixed onto the staple tray 206 are inserted through the stapling jogger fences 208. Each of the stapling jogger fences 208 is coupled to a stepping motor via a timing belt (not shown) to linearly reciprocate as the stepping motor rotates forward and backward. The stapling jogger fences 208 are configured to be movable independently from each other.

After the sheet P has fallen onto the staple stage 250S, the clamp 401 brings the far-side edge Pb into contact with the trailing-end reference fences 207, thereby aligning the sheet P in the sheet conveying direction. The stapling jogger fences 208 align the sheet P in the direction perpendicular to the conveying direction.

An eject guide plate 212 and the eject rollers 209 are disposed most downstream of the staple tray 206. The sheet P conveyed in the direction indicated by arrow B1 to a far-side position in FIG. 2 is then conveyed in the direction indicated by arrow B2 (to the near side) by a releasing claw (not shown). The sheet P is further conveyed in the same direction by the eject rollers 209 to be ejected onto the eject tray 210. The eject rollers 209 perform sheet conveyance in cooperation with a driven roller 213. The driven roller 213 is disposed at a movable end of the eject guide plate 212 and moved up and down by a stepping motor (not shown). The eject rollers 209 and the driven roller 213 convey the sheet P by pinching the sheet P therebetween.

When the sheets P are to be sorted into sets each made up of predetermined number of sheets, an aligning position (the position of the stapling jogger fences 208) for alignment in the direction perpendicular to the sheet conveying direction is shifted a preset distance. The sheet P is ejected from this position onto the eject tray 210. When sheets are loaded onto the eject tray 210 in this manner, positions where the sheets are ejected on the eject tray 210 are alternately shifted every predetermined number of sheets. Sheet sorting is thus achieved.

A sheet hold-down member 220 for holding down the sheets P loaded on the eject tray 210 is disposed at a portion where the eject tray 210 is mounted on a body of the sheet processing device 200. The sheet hold-down member 220 performs sheet hold-down releasing and sheet hold-down retention when a solenoid 221 is switched on and off. Specifically, in synchronization with conveyance of the sheet P, the solenoid 221 is switched on to cause the sheet hold-down member 220 to release hold-down retention; when the sheet P is conveyed past the eject rollers 209, the solenoid 221 is switched off to hold down the sheet P. Even when the solenoid 221 is switched off just when the sheet P is conveyed past the eject rollers 209, the solenoid 221 and the sheet hold-down member 220 are actuated after a certain time lag. This time lag allows the sheet P to be conveyed past the eject rollers 209 and fall onto the eject tray 210, and thereafter be slipped down by the pull of gravity in a direction opposite to the conveying direction. After abutting on an end fence 225, the sheet P is held down by the sheet hold-down member 220 on a movable tray member 222*b*. Alternatively, a configuration in which a delay time is set in advance, and when triggered by passage of the sheet P over the eject rollers 209, the sheet hold-down member 220 holds down the sheet P after the delay time can be employed.

The eject tray 210 includes a fixed tray member 222*a* on a downstream side with respect to the conveying direction and the movable tray member 222*b* on an upstream side. A tray DC motor 223*a* and a cam-link mechanism 223*b* move the movable tray member 222*b* up and down. The movable tray member 222*b* is pivotably supported at its pivot end, or an upstream end portion of the movable tray member 222*b*, by the fixed tray member 222*a* via a support shaft 223*c*. A moving end of the cam-link mechanism 221*b* is coupled to this movable tray 208*b*. With this configuration, when the tray DC motor 223*a* runs, the movable tray member 222*b* pivots about the support shaft 223*c* according to rotation of the tray DC motor 223*a*.

When the number of sheets ejected onto the movable tray member 222*b* reaches a certain value, the tray DC motor 223*a* rotates according to a command fed from a controller, which will be described later, thereby lowering a free end of the movable tray member 222*b*. A tray-sheet-level sensor (not shown) is disposed on the sheet hold-down member 220. The eject tray 210 loaded with the sheets P is maintained at a constant level as follows. When, in a state where the sheets P are held down by the sheet hold-down member 220, the tray-sheet-level sensor outputs a signal indicating OFF, the eject tray 210 is elevated until the sheet-level sensor outputs a signal indicating ON. When the sheet-level sensor outputs a signal indicating ON, the eject tray 210 is lowered until the sheet-level sensor outputs a signal indicating OFF and then elevated until a signal indicating ON is output.

The distance between a nip between the eject rollers 209 and a sheet loading portion of the movable tray member 222*b* is maintained at a constant distance as described above by moving up and down the free end of the movable tray member 222*b* according to a sheet loading state of the eject tray 210 so that a constant contact angle is kept between a sheet ejected by the eject rollers 209 and the movable tray member 222*b*. This allows maintaining consistent alignment quality of sheets loaded on the eject tray 210 and also loading a large number of sheets on the eject tray 210.

By repeating the operations described above, the sheets P are loaded on the eject tray 210 as being sorted.

Staple Mode

In the staple mode, the sheets P are ejected as stapled sheet bundles each of which is made up of predetermined number of sheets and stapled by a stapler.

In the staple mode, the clamp 401 pushes the far-side edge Pb out of the punching unit 270. As the clamp unit 400 vertically moves, the clamp 401 moves until the sheet trailing ends P2 abut on the trailing-end reference fences 207. Sheet alignment in the sheet conveying direction is thus performed. This sheet alignment is performed with reference to the trailing-end reference fences 207 by bringing the sheets P into contact with the trailing-end reference fences 207. When the trailing ends of the sheets P have abutted on the trailing-end reference fences 207, the stapling jogger fences 208 arranged on the staple tray 206 align the sheets P in the direction perpendicular to the sheet conveying direction in a manner similar to that in the shift mode described above.

The stapling jogger fences 208 are disposed on the staple tray 206 as illustrated in FIG. 4. The guide shafts (not shown) fixed onto the staple tray 206 are inserted through the stapling jogger fences 208. Each of the stapling jogger fences 208 is coupled to the stepping motor via the timing belt (not shown) to linearly reciprocate as the stepping motor rotates forward and backward. The stapling jogger fences 208 are configured to be independently movable from each other. The staple tray 206 includes home-position sensors that detect the stapling jogger fences 208 at their standby positions.

The staple tray 206 includes the trailing-end reference fences 207 mounted on a guide shaft (not shown) via a slider. The trailing-end reference fences 207 are configured to be movable in the same direction as the stapling jogger fences 208. A rack held by the slider is meshed with a gear disposed at approximately center of the staple tray 206. The trailing-end reference fences 207 move symmetrically with respect to the gear. The trailing-end reference fences 207 include guide portions at their ends. When a stapler unit 250 is moved, a base (not shown) of the stapler unit 250 contacts an inner side of the guide portion and pushes the guide portion. Accordingly, when the stapler unit 250 is moved, the trailing-end reference fences 207 are moved to follow the stapler unit 250.

Specifically, when the stapler unit 250 is moved toward an end of the staple tray 206, the trailing-end reference fences 207 move away from each other. When the stapler unit 250 is moved toward the center of the staple tray 206, the trailing-end reference fences 207 that are paired with each other approach to each other. This is because an elastic force is exerted to the trailing-end reference fences 207 by a spring (not shown) in a direction toward the center of the staple tray 206.

After the stapling, the eject guide plate 212 is lowered. The sheet bundle PBL is pinched and held between the eject rollers 209 and the driven roller 213 mounted on the eject guide plate 212, and ejected onto the eject tray 210. While the sheet bundle PBL is being ejected, the solenoid 221 is switched on to cause the sheet hold-down member 220 to release hold-down retention, and the eject tray 210 is lowered a predetermined amount. Subsequently, at a time when the trailing end of the sheet bundle PBL passes by a bundle eject sensor 224, the eject guide plate 212 is elevated to prepare for receiving a next sheet. At the same time, the solenoid 221 is switched off to perform sheet hold-down retention. At this time, the solenoid 221 and the sheet hold-down member 220 are actuated after a predetermined time lag. This time lag lets the sheet bundle PBL fall on the movable tray member 222*b*, the trailing end of the sheet bundle PBL abut on the end fence 225, and thereafter the sheet bundle PBL be held down by the sheet hold-down member 220 on the movable tray member 222*b*.

Figure 6:
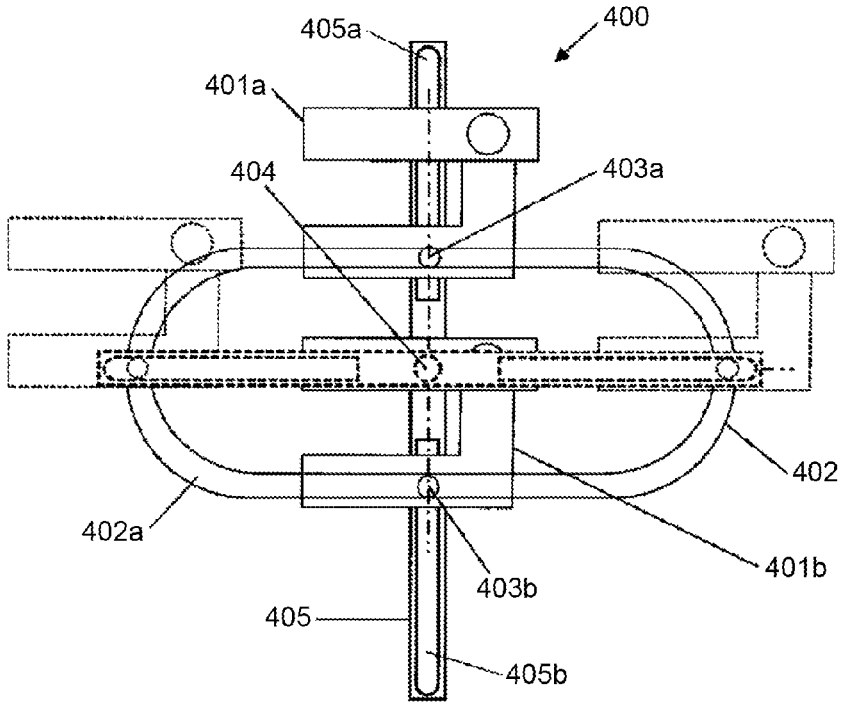
FIG. 6 is a front view illustrating a configuration of the clamp unit and a moving mechanism for the clamp unit.

FIG. 6 is a front view illustrating a configuration of the clamp unit and a moving mechanism for the clamp unit. The clamp unit 400 includes the first clamp 401*a*, the second clamp 401*b*, the guide 402 that is elliptical when viewed from the front, and a link 405. A pivot point (rotation center) 404 of the link 405 is at center of the guide 402. The first clamp 401*a* and the second clamp 401*b* include a first guide member 403*a* and a second guide member 403*b*, respectively, on a base 501 which will be described later. The link 405 has first and second grooves 405*a* and 405*b*. The guide 402 also has a guide groove 402*a*.

The guide 402 is fixed to a casing of the sheet finisher 400. The link 405 is mounted to be rotatable relative to the pivot point 404. As illustrated in FIG. 6, the first and second grooves 405*a* and 405*b* are arranged so as to overlap the guide groove 402*a*. The first and second guide members 403*a* and 403*b* are movably attached to the link 405 and to the guide 402 in such a manner that the first guide member 403*a* and the second guide member 403*b* extend through the first groove 405*a* and the second groove 405*b*, respectively. With this configuration, when the link 405 is rotated about the pivot point 404 by a driving motor (not shown), the first and second guide members 403*a* and 403*b* move along the guide groove 402*a* while reciprocating inside the first and second grooves 405*a* and 405*b*, respectively. As a result, the clamps 401 circle around in a loop through the position indicated by solid lines and the position indicated by dashed lines in FIG. 6. At this time, the first and second clamps 401*a* and 401*b* that stay horizontal move up and down and to the left and to the right along the guide 402. Moving motions of the clamp unit 400 as a whole and operation timing for clamping and releasing clamping the sheet bundle PBL have already been described above with reference to FIG. 5.

Figure 7:
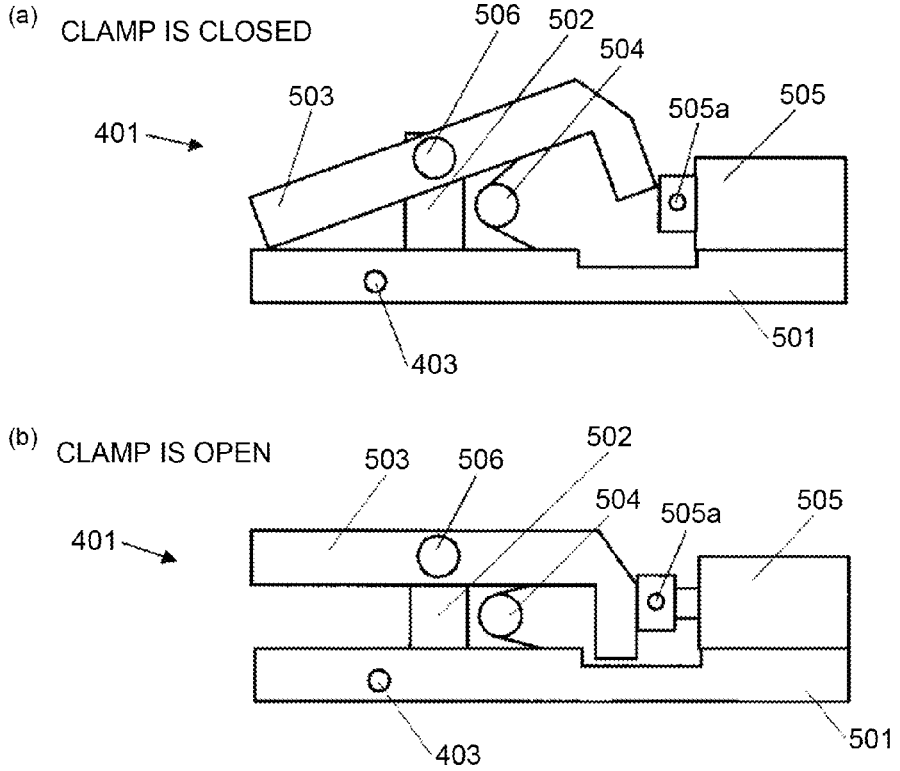
FIG. 7 illustrates a configuration of a clamp.

FIG. 7 illustrates a configuration of the clamp 401. The first and second clamps 401*a* and 401*b* are identical in configuration, and collectively referred to as the clamps 401 with reference symbols a and b omitted. The clamp 401 includes the base 501, the abutting member 502, an open/close member 503, a torsion spring 504, and a solenoid 505. The open/close member 503 is rotatably supported by a pivot point 506 at a distal end of the abutting member 502. The solenoid 505 is arranged on a side of a first end of the open/close member 503. The torsion spring 504 constantly exerts an elastic force to the open/close member 503 in a direction that opens the first end. Illustrated in (a) of FIG. 7 is a state where the open/close member 503 is closed. In this state, the sheet P is clamped. In this state, the torsion spring 504 exerts a pressure that allows clamping the sheet P between the open/close member 503 and the base 501. In this state, the solenoid 505 is off. Accordingly, an actuator 505*a* of the solenoid 505 contacts the first end of the open/close member 503 and is pushed by the first end, thereby being placed in a most withdrawn state.

Illustrated in (b) of FIG. 7 is the clamp 401 in an open state. When the solenoid 505 of the clamp 401 in the state illustrated in (a) of FIG. 7 is switched on, the actuator 505 protrudes to push the first end of the open/close member 503, thereby rotating the open/close member 503 clockwise in (a) of FIG. 7 against the elastic force exerted by the torsion spring 504. Consequently, a second end of the open/close member 503 moves away from the base 501 and separates therefrom to release the sheet P from the clamped state.

When associated with FIG. 5 and FIG. 6, this open/close operations (clamping operation and clamp-releasing operation) illustrated in FIG. 7 can be described as follows. In (a) of FIG. 5, the first clamp 401*a* is open (clamp-released state), and the second clamp 401*b* is closed (clamping state); the first clamp 401*a* is closed, and the second clamp 401*b* is open in (b) of FIG. 5; the first clamp 401*a* is open, and the second clamp 401*b* is open in (c) of FIG. 5; both the first clamp 401*a* and the second clamp 401*b* are open in (d) of FIG. 5. The clamping operation and the clamp-releasing operation are performed by the solenoid 505 as described above. These operations are executed by a central processing unit (CPU) of a control circuit (not shown) as in the case of the rotation of the link 405.

As described above, according to the present embodiment, the following effects are obtained.

1) it is possible to position the sheets P on a desired one of the punch stage 270S and the staple stage 250S by simply moving the link 405 in a loop so as to move the clamps 401 along the guide 402. Accordingly, because the sheet processing device can have a simple structure and does not require a large driving source to move the sheets P, device miniaturization can be achieved.

2) The sheet finisher 200 includes the punching unit 270 that punches holes at punching positions parallel to the sheet conveying direction B1 in which the sheets P are received from the image forming apparatus 100, and the stapler unit 250 that staples the sheets P at stapling positions parallel to the sheet conveying direction B1. The unit 270 and the unit 250 are arranged above and below with respect to each other. Delivery of the sheets P to the punch stage 270S and to the staple stage 250S is performed by clamping a portion of the sheets P with the first clamp 401*a* or the second clamp 401*b* and moving the sheets P along the guide 402. Accordingly, an increase of the sheet finisher 200 in size is prevented.

3) When the punching unit 270 punches holes, an edge face of the sheets P on a side where the holes are to be punched is brought into contact with the abutting member 502 of the clamp 401 to perform positioning. Accordingly, hole punching through the sheets P can be performed accurately.

4) When the punching unit 270 punches holes, the edge face of the sheets P on the side where the holes are to be punched is brought into contact with the abutting member 502 of the clamp 401 to perform positioning. Thereafter, the sheets P are clamped by the clamping member and then punched. Accordingly, the holes can be punched accurately because the sheets P do not go out of order during punching.

5) After the holes are punched by the punching unit 270, the sheets P are moved from the punch stage 270S to the staple stage 250S while being kept to be clamped by the clamp 401. Accordingly, even when the sheets P are moved up and down, the sheets P are moved onto the staple tray 206 orderly without going out of order.

6) The clamp 401 provides double functions, which are a sheet-edge-face aligning function for the punching unit 270 and a sheet-edge-face aligning function for the stapler unit 250. Accordingly, it is possible to perform punching and stapling on the sheets P accurately with an inexpensive structure.

7) The clamp unit 400 includes the first and second clamps 401*a* and 401*b* that are supported by the link 405. Accordingly, it is possible to perform punching and stapling while maintaining high productivity.

8) A moving path of the clamps 401 are looped along the guide 402. Accordingly, it is possible to perform punching and stapling while maintaining high productivity.

According to the embodiments, a sheet processing device is capable of moving sheets with a simple structure without using a large driving source. Accordingly, device miniaturization can be achieved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing device comprising:

a clamp configured to clamp an edge portion of a sheet, the edge portion being on a side of an edge parallel to a direction in which the sheet has been conveyed;

a first processing unit configured to perform a first process on the sheet at the side of the edge, the first processing unit being disposed at a first position;

a second processing unit configured to perform a second process on the sheet at the side of the edge, the second processing unit being disposed at a second position that is different from the first position in a vertical direction; and a moving unit configured to move the clamp from the first position to the second position or vice versa so that the clamp moves on a loop passing through the first position and the second position.

2. The sheet processing device according to claim 1, wherein the clamp includes a positioning member configured to position the sheet by abutting against the edge of the sheet.

3. The sheet processing device according to claim 2, wherein each of the first processing unit and the second processing unit performs a predetermined process after the positioning member performs the positioning.

4. The sheet processing device according to claim 3, wherein the first processing unit is a hole puncher that performs hole punching on the sheet after the sheet is positioned at the first position and clamped by the clamp.

5. The sheet processing device according to claim 4, wherein the moving unit moves the clamp to the second position with the sheet being clamped by the clamp after the sheet is punched.

6. The sheet processing device according to claim 5, wherein the second processing unit is a stapling unit, and the clamp releases the sheet at the second position.

7. The sheet processing device according to claim 1, further comprising another clamp to clamp the edge portion of the sheet, the another clamp being moved on the loop by the moving unit.

8. The sheet processing device according to claim 7, wherein the moving unit moves the clamps along a guiding member on the loop.

9. An image forming apparatus comprising the sheet processing device according to claim 1.

* * * * *